United States Patent [19]

Rieger

[11] 4,122,528

[45] Oct. 24, 1978

[54] INTEGRATOR CIRCUITS FOR A CONSTANT VELOCITY VECTOR GENERATOR

[75] Inventor: Michael Lawrence Rieger, Beaverton, Oreg.

[73] Assignee: Tektronix, Inc., Beaverton, Oreg.

[21] Appl. No.: 774,712

[22] Filed: Mar. 4, 1977

Related U.S. Application Data

[62] Division of Ser. No. 625,609, Oct. 24, 1975, Pat. No. 4,032,768.

[51] Int. Cl.[2] ..... G06G 7/18

[52] U.S. Cl. ..... 364/829; 307/229; 328/127; 364/834

[58] Field of Search ..... 235/183; 307/229, 230; 328/127; 364/829, 834

[56] References Cited

U.S. PATENT DOCUMENTS

| | | | |
|---|---|---|---|
| 3,076,933 | 2/1963 | Negrete | 235/183 UX |
| 3,466,434 | 9/1969 | Goldstein | 235/183 |
| 3,689,752 | 9/1972 | Gilbert | 307/229 X |
| 3,790,893 | 2/1974 | Corwin | 328/127 X |
| 3,891,840 | 6/1975 | Cloke | 328/127 X |

*Primary Examiner*—Joseph F. Ruggiero
*Attorney, Agent, or Firm*—George T. Noe

[57] ABSTRACT

A Constant Velocity Vector Generator is disclosed for connecting X, Y coordinate points of a rectangular coordinate display system. A pair of absolute value amplifier circuits, a square-root-of-the-sum-of-the-squares circuit, a pair of dividers, and a pair of integrators are employed to convert simultaneous ΔX and ΔY step voltages to ramp voltage pairs which are applied to appropriate X and Y deflection circuits of a graphic display device to produce straight-line traces whose velocities are constant for all vectors regardless of magnitude (line length) or direction (angle). Each vector may be drawn to any length or direction, immediately after which new data may be applied to the vector generator to initiate a new vector whose origin is the end point of the preceding vector. Such a system is particularly applicable to computer-drawn displays. The vector generating circuits are suitable for realization in a monolithic integrated circuit.

1 Claim, 6 Drawing Figures

INTEGRATOR CIRCUITS FOR A CONSTANT VELOCITY VECTOR GENERATOR

This is a division of application Ser. No. 625,609, filed Oct. 24, 1975, now U.S. Pat. No. 4,032,768.

BACKGROUND OF THE INVENTION

This invention generally relates to graphic display devices and more specifically to electronic circuits for generating control voltages, or vectors, for drawing straight lines between data points in a Cartesian coordinate system having a horizontal (X) axis and a vertical (Y) axis. The data points may be described in coordinate pairs, e.g., i $x_o$, $y_o$; $x_1$, $y_1$; $x_2$, $y_2$; $x_3$, $y_3$; etc.

According to the rules of vector algebra, any vector $\bar{R}$ may be described by the sum of the vector components along the X and Y axis. The mathematical expression for a vector connecting a pair of data points 0 and 1, for example, is $$\bar{R} = (x_1 - x_o)\bar{i} + (y_1 - y_o)\bar{j}$$

where $\bar{i}$ and $\bar{j}$ are vector symbols corresponding to the X and Y axis respectively, and the magnitude of $\bar{R}$ may be obtained from the expression $$R = [(x_1 - x_o) + (y_1 - y_o)]^{\frac{1}{2}}$$

which is the familiar square root of the sum of the squares which is utilized to calculate the diagonal of a right triangle.

In the field of computer graphics, various vector generator schemes have been devised for increasing computer efficiency by reducing the writing time for a display image. Typically, the computer provides information defining the location of a series of data points, which when connected together form the image. One scheme for forming the mathematical representation of a vector is taught by U.S. Pat. No. 3,772,563 to Hasenbalg, in which straight lines are drawn between data points on a cathode-ray tube screen. In this patent, however, the vector drawing speed is not constant, but is an exponential function. Since line width and brightness may vary noticeably with the speed at which a vector is drawn, it is an important requirement that the "writing speed" of the writing element (e.g., electron beam in a cathode-ray tube device or ink pen in a X-Y plotter device) is constant over the entire length of the line.

A system for generating vectors of variable length and angle in which the writing speed is substantially constant, regardless of line length or angle, is described in U.S. Pat. No. 3,800,183 to Halio. In this particular system, two binary numbers identify the deflection components ΔX and ΔY. The component having the greater magnitude is detected and utilized to set the slope of a ramp voltage which in turn energizes two digital-analog converter circuits in parallel. Each converter circuit produces an output which is a function of the product of the ramp voltage and a binary number corresponding to the ΔX or ΔY component. The output signals, which when applied to the X and Y deflection circuitry, produce a vector which is drawn at a constant velocity. The circuitry which is required to produce these output signals is complex and requires many electrical components.

SUMMARY OF THE INVENTION

According to the present invention, input step voltage pairs $V_{sx}$ and $V_{sy}$ corresponding to ΔX and ΔY changes from one data point at $t_o-$ to another at $t_o+$ are simultaneously converted to ramp voltage pairs $V_{rx}$ and $V_{ry}$ in accordance with the following mathematical expressions:

$$V_{rx} = \frac{R}{C} \int \frac{V_{sx} - V_{rx}}{\sqrt{(VV_{sx} - V_{rx})^2 + (V_{sy} - V_{ry})^2}}\, dt \qquad (3)$$

$$V_{ry} = \frac{R}{C} \int \frac{V_{sy} - V_{ry}}{\sqrt{(V_{sx} - V_{rx})^2 + (V_{sy} - V_{ry})^2}}\, dt \qquad (4)$$

Equations (3) and (4) are valid only during vector generation, since the expressions would otherwise be equal to zero when $V_{sx} = V_{rx}$ and $V_{sy} = V_{ry}$. The values $V_{rx_o}$ and $V_{ry_o}$ are the initial values prior to vector generation.

In the preferred embodiment of the present invention, the absolute value of $V_s - V_r$ is converted to a current for such axis, such currents being combined in a square-root-of-the-sum-of-the-squares (SSS) circuit to produce an error current. A divider circuit produces a current proportional to the ratio of the difference current to the error current which is applied to an integrator circuit. Since the ratio is substantially constant during vector generation, the current to the integrator is substantially constant, resulting in a linear output voltage between the start and stop levels.

The system takes advantage of the non-linear properties of well-matched transistors to provide a relatively simple circuit in comparison to those of the prior art. The vector writing speed is determined by two capacitors, making the circuit readily adaptable to provide writing speeds for stored or refreshed cathode-ray tube displays and for electro-mechanical plotters.

It is, therefore, one object of the present invention to provide integrator circuits in a system which draws constant velocity vectors for any length or direction.

It is another object to provide a vector display having uniform line widths and intensity.

It is a further object to increase efficiency of computer-drawn displays.

It is yet another object to provide a versatile constant velocity vector generator which may readily be utilized in ultra-fast or ultra-slow modes.

It is yet a further object to provide a constant velocity vector generator which may be realized in integrated circuit form.

It is an additional object to provide a constant velocity vector generator which may be fabricated simply and at reduced cost.

This invention is pointed out with particularity in the appended claims. A more thorough understanding of the above and further objects and advantages of this invention may be obtained by referring to the following description taken in conjunction with the accompanying drawings.

DRAWINGS

DETAILED DESCRIPTION OF THE DRAWINGS

Figure 1:
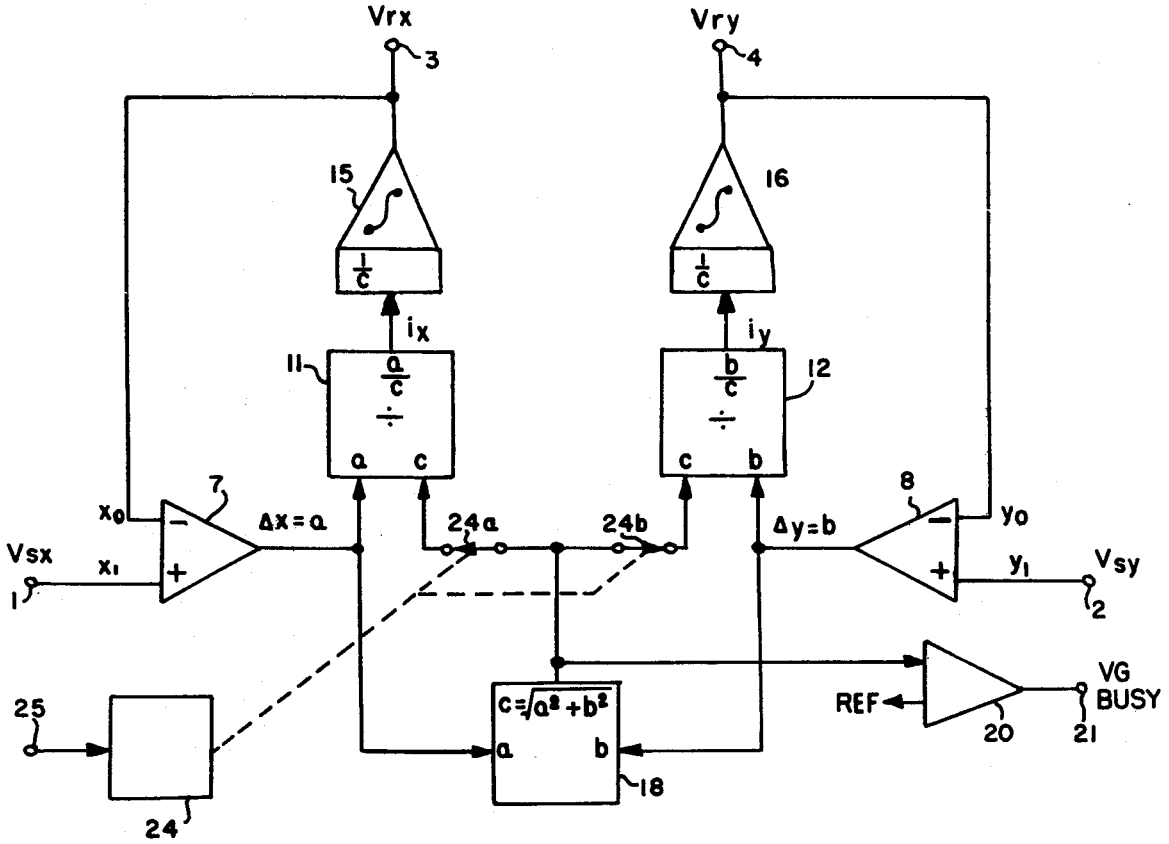
FIG. 1 shows a block diagram of a constant velocity vector generator system according to the present invention.
Figure 2:
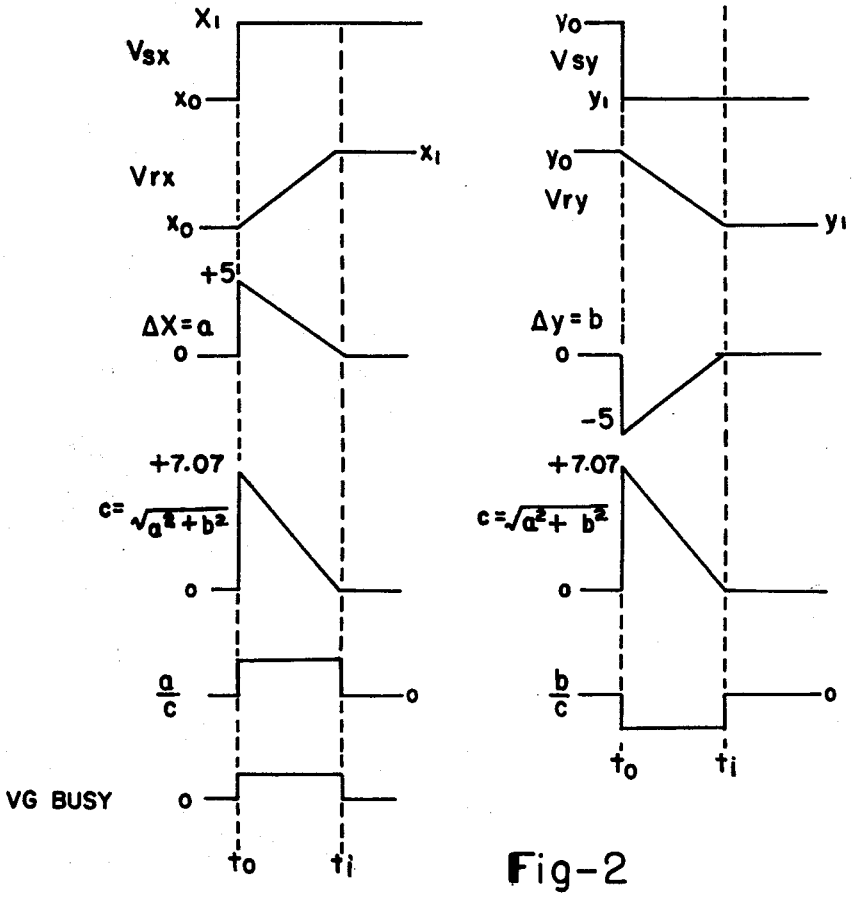
FIG. 2 is a ladder diagram showing waveform relationships in accordance with a block diagram of FIG. 1.

Turning now to the drawings, there is shown in FIGS. 1 and 2 a block diagram of a constant velocity vector generator and its associated waveforms. FIG. 1 is an analog computer type model to facilitate explanation of the mathematical relationships. The basic vector generator comprises a pair of input terminals 1 and 2, a pair of output terminals 3 and 4, a pair of summers 7 and 8, a pair of dividers 11 and 12, a pair of integrators 15 and 16, and a square-root-of-the-sum-of-the-squares (SSS) circuit 18, interconnected in a pair of closed loops. Step voltage signals $V_{sx}$ and $V_{sy}$ corresponding respectively to the X and Y axis of a Cartesian coordinate system are simultaneously applied in pairs to input terminals 1 and 2. $V_{sx}$ and $V_{sy}$ may be supplied via a pair of digital-to-analog converters from a computer or the like, and represent data points of the coordinate system.

Time $t_o$ in FIG. 2 corresponds to the application of a pair of step signals $V_{sx}$ and $V_{sy}$, which for purposes of explanation in this example are $x_1 - x_o = +5$ and $y_1 - y_o = -5$ volts respectively. Values $x_o$ and $y_o$ may be any arbitrary value corresponding to a data point position. New voltage values $x_1$ and $y_1$ are summed with old voltage values $x(t)$ and $y(t)$ for $x_o = x(T) + x_1$ and $y_o = y(t) + y_1$, respectively, in summers 7 and 8 to produce a pair of difference signals $a$ and $b$, which step to +5 and −5 volts respectively and return linearly to zero volts at time $t_1$ as the ramp voltage outputs $V_{rx}$ and $V_{ry}$ are developed. The difference signals $a$ and $b$ are applied to the SSS circuit 18 to develop an error signal $c$, which is equal to +7.07 volts (the square root of 25 + 25 = 50) at time $t_o$ and returns linearly to zero volts at time $t_1$.

Divider circuits 11 and 12 receive the difference signals $a$ and $b$ respectively, and the error signal $c$, and provide output currents which are proportional to the ratios of the difference signals to the error signal. Since these ratios are substantially constant, the currents $i_x$ and $i_y$ to integrators 15 and 16 are substantially constant, resulting in linearly changing output voltages $V_{rx}$ and $V_{ry}$. The time difference $t_1 - t_o$ is dependent upon the resistance R and the capacitance C in the circuit. Expressed mathematically, $$x(t) = \frac{R}{C} \int_{t_o}^{t_1} \frac{a}{\sqrt{a^2 + b^2}}\, dt \tag{5}$$

$$y(t) = \frac{R}{C} \int_{t_o}^{t_1} \frac{b}{\sqrt{a^2 + b^2}}\, dt \tag{6}$$

where $a = x_1 - x(t)$ and $b = y_1 - y(t)$. It can be discerned that these are equivalent to the vector equations (3) and (4) by substituting values $x(t) = V_{rx}$, $x_1 = V_{sx}$ at $t_o+$, $y(t) = V_{ry}$, and $y_1 = V_{sy}$ at $t_o+$ into equations (5) and (6).

A comparator 20 receives the error signal $c$ and compares it to a zero voltage reference to produce an output signal via terminal 21 to notify other circuits that a vector is being drawn. After a vector connecting two data points is completed, the vector generator may accept new step voltages $V_{sx}$ and $V_{sy}$.

To move the writing element quickly from one point to another, for example, after one display line is written and it is desired to begin a new line, a fast slew circuit 24 is provided to open switch contacts 24a and 24b. This action inhibits current from the SSS circuit 18, causing the capacitors of integrators 15 and 16 to charge at a rate determined by the output capabilities of such integrators, thereby causing the outputs of integrators 15 and 16 to quickly slew to the value of the input step voltages. This can be seen mathematically by allowing the denominators of equations (5) and (6) to approach zero, essentially defining a Dirac delta function. Fast slew circuit 24 may suitably be a transistor switch or a relay switch, depending upon the speed at which the vector generator is operated. Command signals to fast slew circuit 24 are input via terminal 25.

Figure 3:
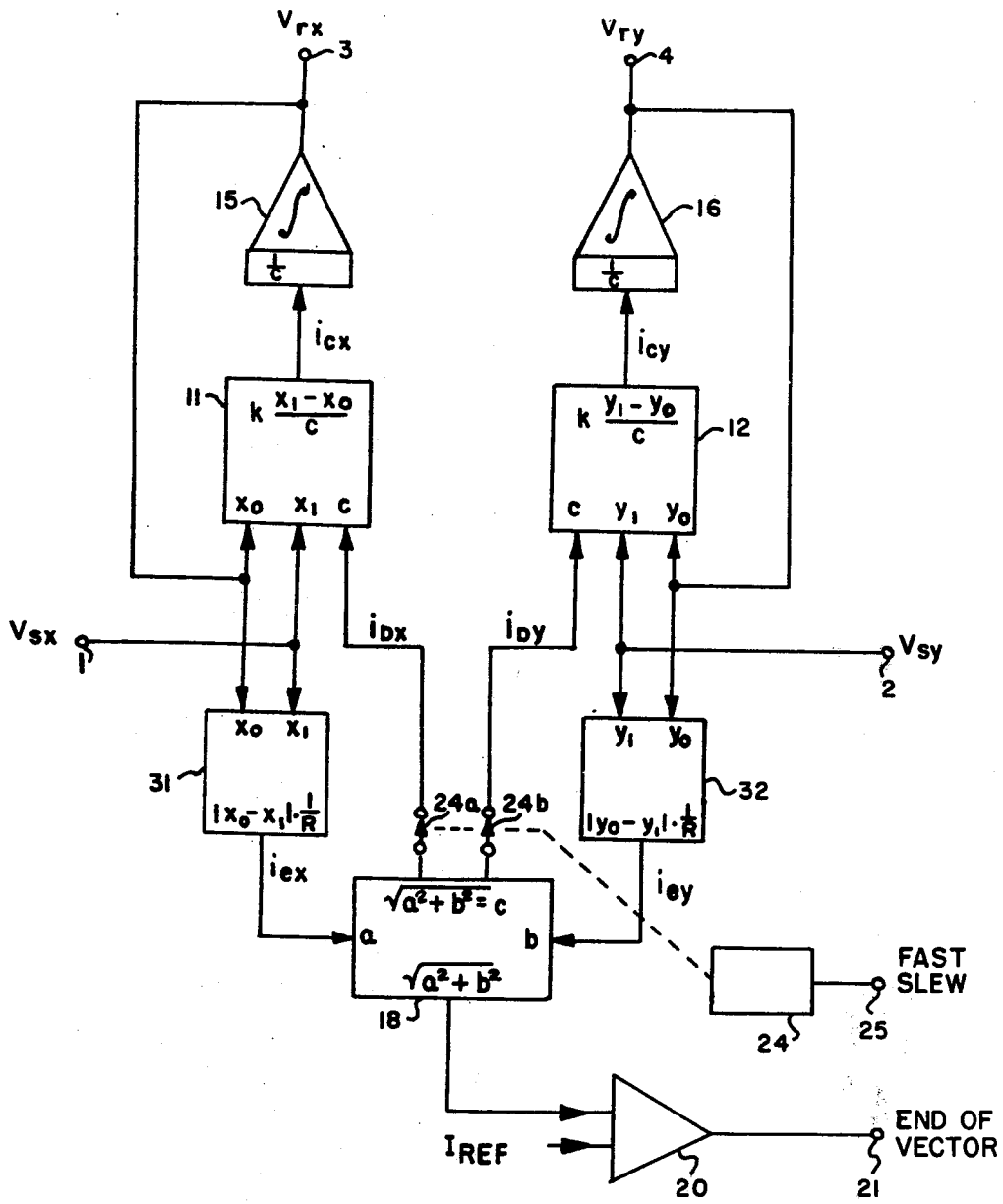
FIG. 3 shows a block diagram of the system in accordance with the preferred embodiment.

FIG. 3 illustrates an analog computer-type model of the constant velocity vector generator in accordance with the preferred embodiment. The model is a slight modification of that shown in FIG. 1 and uses like reference numerals where possible. This circuit includes a pair of difference-to-absolute value-to-current converter circuits 31 and 32 which generate currents $i_{ex}$ and $i_{ey}$ to be utilized respectively as the $a$ and $b$ inputs to the SSS circuit 18. Current $i_{ex}$ is proportional to the absolute value of the difference between $x_o$ and $x_1$, and likewise current $i_{ey}$ is proportional to the absolute value of the difference between $y_o$ and $y_1$. The output of SSS circuit 18 is in the form of equal currents $i_{Dx}$ and $i_{Dy}$, which currents are applied to the divider circuits 11 and 12 respectively. Divider circuits 11 and 12 perform the summing function to produce difference values $x_1 - x_o$ and $y_1 - y_o$, and generate substantially constant currents $i_{cx}$ and $i_{cy}$ for integration by integrators 15 and 16.

Consequently, it can be seen from equations (5) and (6) that linear ramp voltages $V_{rx}$ and $V_{ry}$ are generated. Such ramp voltages, when applied to the X and Y deflection circuits of a cathode-ray tube or an electromechanical X-Y plotter produce vectors which are drawn at a constant velocity.

The comparator 20 and fast slew circuit 24 operate substantially as described previously with reference to FIG. 1.

Figure 4:
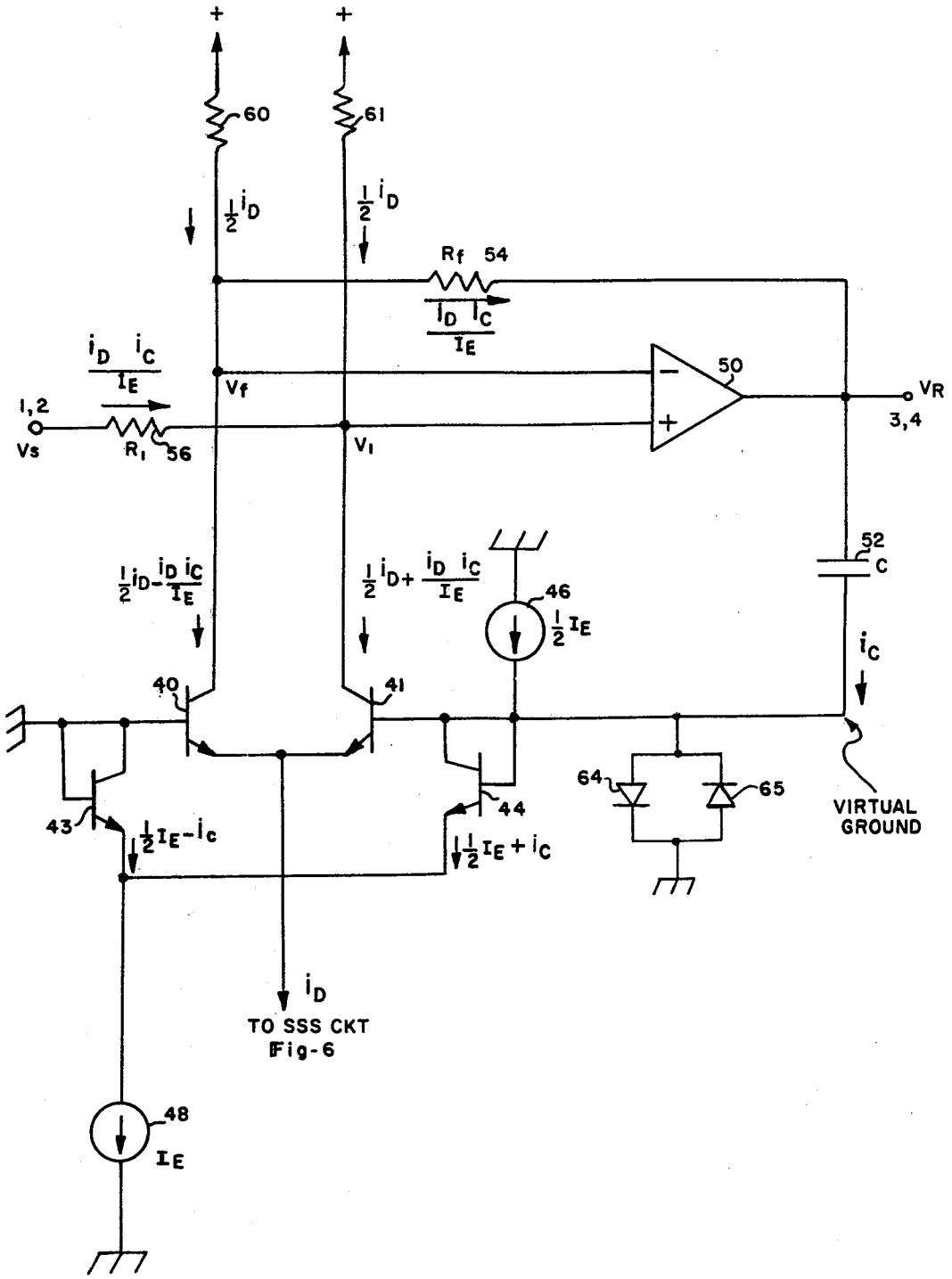
FIG. 4 is a schematic of the divider-integrator circuit portion of the system of FIG. 3.

The dividers 11 and 12 and integrators 15 and 16 of FIG. 3 are identical for both the X and Y axes, so it is therefore necessry to examine only one divider-integrator combination in detail with the understanding that such description applied to both. A detailed schematic of the divider-integrator circuit is shown in FIG. 4, wherein the X and Y subscripts have been dropped. A differentially-connected pair of NPN transistors 40 and 41 are shown, having in the base circuits thereof a second pair of differentially-connected NPN transistors 43 and 44. Transistors 43 and 44 are shown connected as diodes. The base of transistor 40, and consequently the collector of transistor 43, is connected to ground. The base of transistor 41, and hence the collector of transistor 44, is connected to a constant current generator 46. The emitters of transistors 43 and 44 are connected together and to a constant current sink 48. This circuit configuration is known as the Gilbert gain cell and is fully described in U.S. Pat. No. 3,689,752. An operational amplifier 50 has its two inputs connected to the collectors of transistors 40 and 41 respectively. The output of operational amplifier 50 is connected to an output terminal 3, 4, and through a feedback capacitor 52 to the base of transistor 41. A feedback resistor 54 is connected from the output of operational amplifier 50 to the collector of transistor 40. An input terminal 1, 2 is connected through a resistor 56 to the collector of transistor 41. Collector current for transistors 40 and 41 is provided through a pair of large resistors 60 and 61 respectively from a source of positive voltage. A pair of diodes 64 and 65 provide clamping action during fast slew to maintain the virtual ground at the base of transistor 41.

The currents which are set up in the divider-integrator circuit are shown in FIG. 4, wherein $I_E$ is the combined emitter currents of transistors 43 and 44, $i_D$ is the combined emitter currents of transistors 40 and 41, and $i_c$ is the constant charging current of capacitor 52. Furthermore, current $i_D$ is the error current generated by the SSS circuit 18. Assuming that the values of resistors 54 and 56 are to be identical and that the voltages at nodes $V_f$ and $V_l$ are identical because of the action of operational amplifier 50, suitable values for R and C may be found mathematically as follows:

$$\frac{V_s - V_l}{R} = \frac{i_D i_C}{I_E} \tag{7}$$

$$\frac{V_r - V_f}{R} = -\frac{i_D i_C}{I_E} \tag{8}$$

Combining equations (7) and (8).

$$\frac{2\, i_D i_C}{I_E} = \frac{V_s - V_l}{R} - \frac{V_r - V_l}{R} = \frac{V_s - V_r}{R}. \tag{9}$$

Solving for $i_c$ and integrating leads to the expression for $V_r$:

$$i_c = \frac{(V_s - V_r)\, I_E}{2 i_D R} = C\frac{dV_r}{dt} \tag{10}$$

$$V_r = \frac{1}{C}\int i_c\, dt \text{ for } V_s \neq V_r. \tag{11}$$

Certain constraints must be placed upon currents flowing in a circuit of FIG. 4 to prevent saturation of the Gilbert gain cell, and a following table shows those constraints and viable selected values.

Table I

| |
|---|
| $i_c(\max) < \frac{1}{2} I_E$ |
| $\left(\frac{V_s - V_r}{R}\right)_{max} < i_{D(max)}$ |
| $i_{c(max)} \cong 300\ \mu A$ |
| $I_E = 800\ \mu A$ |
| $i_{D(max)} = 400\ \mu A$ |
| $(V_s - V_r)_{max} \cong 10\ V$ |

Utilizing the values given in Table 1, the values of resistors 54 and 56 may be found from equation (9) to be 33 kΩ. The value of capacitor 52 may be found from equation (10) and for a knowledge of the maximum writing speed of the display system. For example, in a cathode-ray tube display device the rate of change of deflection voltage to provide a maximum writing speed of 13,000 centimeters per second may be 6,500 volts per second. The value of $i_C$ divided by this dv/dt yields a capacitance value of 0.046 microfarads.

An additional benefit of the circuit shown in FIG. 4 is that it may have application as a one-pole active filter. This may be achieved by sinking the emitter currents of transistors 40 and 41 to a constant current sink rather than to a variable current sink, holding $i_D$ constant.

Figure 5:
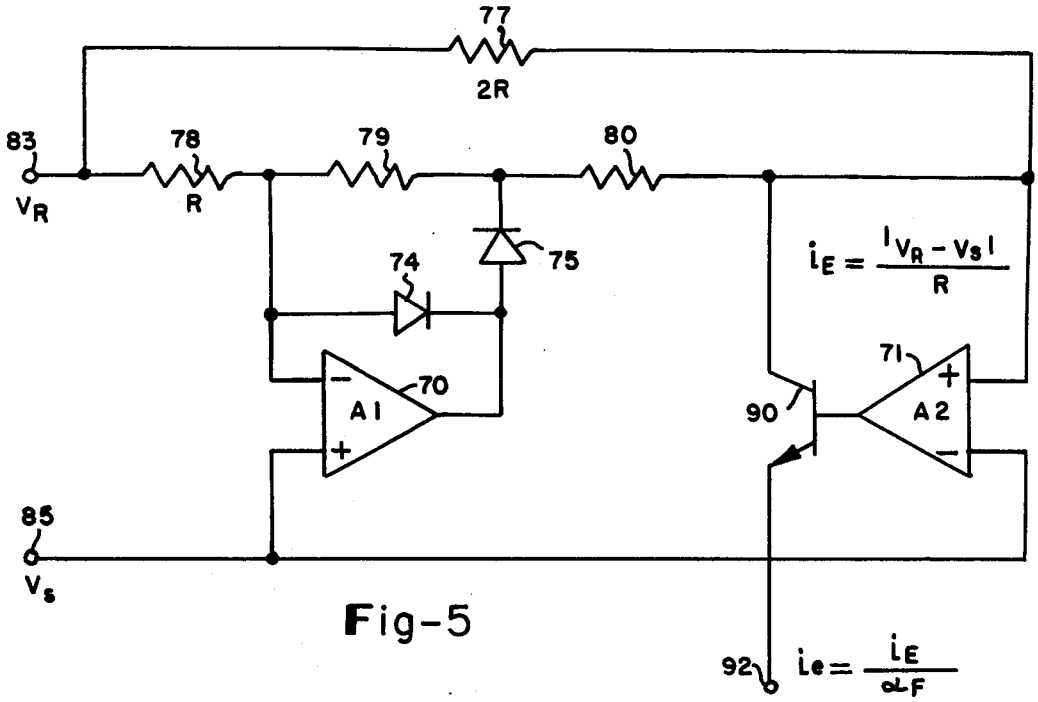
FIG. 5 is a schematic of the difference to absolute value-to-current converter portion of the system of FIG. 3.

FIG. 5 shows a schematic of the difference-to-absolute value-to-current converter portion of the constant velocity vector generator, which was previously referred to as blocks 31 and 32 of FIG. 3. Since the circuits are identical for both the X and Y axes, only one will be described, with the understanding that the description applies to both. For this reason, $x$ and $y$ subscripts have been dropped.

The circuit shown in FIG. 5 is a precision absolute value circuit modified to include difference and current conversion functions. Precision absolute value circuits are well known in the art, and are fully described in the book, "Applications of Operational Amplifiers", by Jerald G. Graeme, McGraw Hill, 1973. The circuit includes operational amplifiers 70 and 71, rectifying diodes 74 and 75, and resistors 77, 78, 79 and 80. The value of resistor 77 is twice that of resistor 78, and the values of resistors 79 and 80 are equal. The values chosen are a matter of design choice.

Output ramp voltage $V_r$ is applied to terminal 83, and input step voltage $V_s$ is applied to terminal 85. As a departure from the prior art, the + and − terminals of operational amplifiers 70 and 71 respectively, are connected to terminal 85 so that they may float with the incoming step voltage, rather than being grounded In this manner, then, the absolute value of the difference between two voltage signals $V_r$ and $V_s$ may be obtained.

The conversion of the absolute voltage value to a current is achieved by transistor 90, the collector of which is connected to the + terminal of operational amplifier 71 and the base of which is connected to the output of the operational amplifier. The collector current flowing into transistor 90 is equal to the absolute value of $V_r - V_s$ divided by a resistance value of resistor 78. The emitter current $i_e$ of transistor 90 is modified by the forward alfa factor of the transistor and made available to the SSS circuit via terminal 92.

Figure 6:
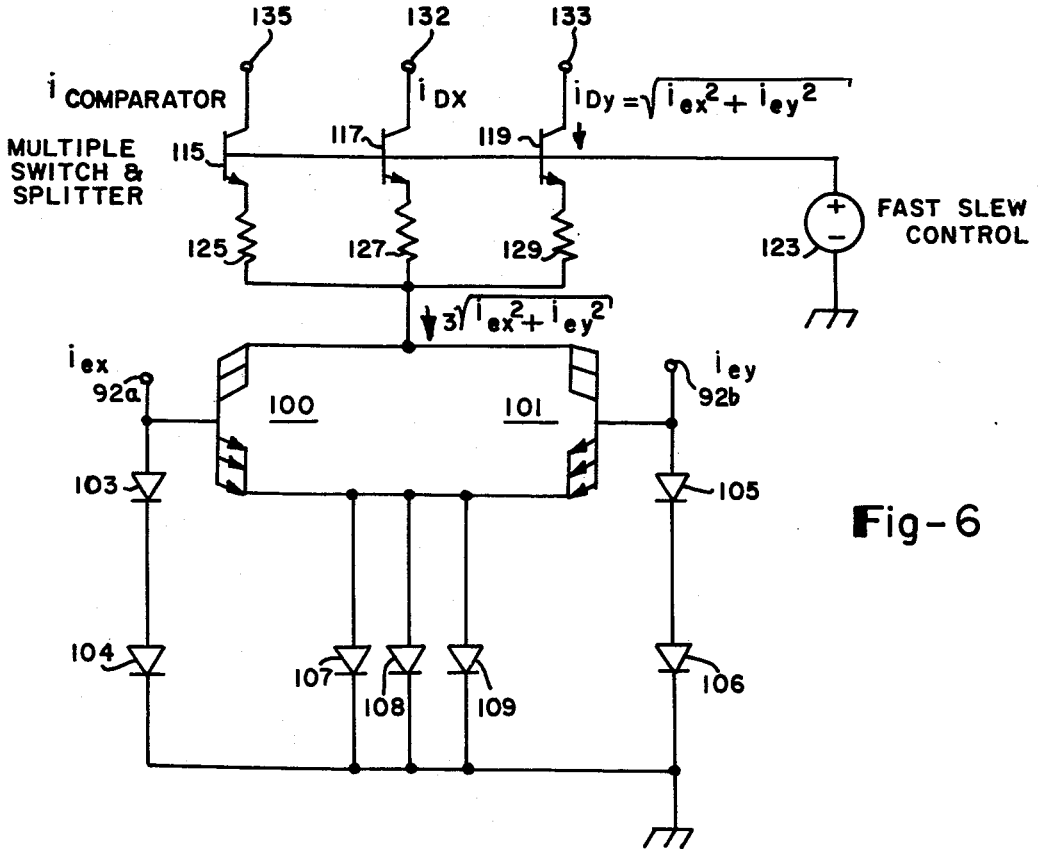
FIG. 6 is a schematic of the square-root-of-the-sum-of-the-squares generator portion of the system of FIG. 3.

The circuit for performing the square-root-of-the-sum-of-the-squares function is shown in FIG. 6. The translinear device comprising emitter-coupled transistors 100 and 101, base diodes 103, 104, 105 and 106, and emitter diodes 107, 108 and 109, is well known in the art, and an example may be found in "Electronic Letters", Volume 10, No. 21, pages 439 and 440. Difference currents $i_{ex}$ and $i_{ey}$ are applid from the absolute value circuits (blocks 31 and 32 of FIG. 3) to terminals 92*a* and 92*b* respectively. The base voltage values of transistors 100 and 101 with respect to ground are generated in accordance with the logarithmic characteristics of the semiconductor diode junctions, and without delving into the physics of the devices which are well known, it may be said that the combined collector current for transistors 100 and 101 is equal to three times the square root of the sum of $(i_{ex})^2$ and $(i_{ey})^2$. Integrated circuit techniques permit the characteristics of these transistors and diodes to be closely matched to minimize error between the inputs and outputs.

The output current is split into three equal portions, each of which is proportional to the magnitude of the vector being generated, by matched transistors 115, 117 and 119. These transistors are biased by a voltage applied to the bases thereof from a voltage source 123 and equal valued emitter resistors 125, 127 and 129. Currents $i_{dx}$ and $i_{dy}$ are made availabe to the divider circuits (blocks 11 and 12 of FIG. 3) via terminals 132 and 133 respectively, and an equal current is made available to the comparator circuit 20 (FIGS. 1 and 3) via terminal 135. Transistors 115, 117 and 119 may be turned of for fast slewing of the writing medium, as discussed previously by opening voltage source 123.

While I have shown and described herein the preferred embodiment of my invention, it will be apparent to those skilled in the art that many changes and modifications may be made without departing from my invention in its broader aspects. For example, a less precise system may be obtained by replacing the square-root-of-the-sum-of-the-squares circuit with a circuit to determine maximum ($|i_a|$, $|i_b|$) error currents to provide therefrom an error current which when divided would provide an approximation of the vector angles and magnitudes.

I claim:

1. An integrating circuit, comprising:

differential amplifier means including differentially connected first and second transistors and a pair of input elements coupled to the bases of said transistors respectively for converting a difference current to a difference voltage for application to said bases, said input elements having logarithmic conduction characteristics substantially corresponding to that of a semiconductor junction;

operational amplifier means having − and + terminals and an output terminal, said − and + terminals connected to the collectors of said first and second transistors respectively;

an input terminal for receiving step voltage signals, said input terminal coupled to said + input terminal of said operational amplifier;

feedback means including a resistive element connected from said output terminal of said operational amplifier means to the − input terminal of said operational amplifier, said feedback means further including a capacitive element connected from said output terminal of said operational amplifier means to the base of said second transistor; and current source means connected to the emitters of said differentially connected first and second transistors.

* * * * *

UNITED STATES PATENT AND TRADEMARK OFFICE

CERTIFICATE OF CORRECTION

PATENT NO. : 4,122,528

DATED : October 24, 1978

INVENTOR(S) : MICHAEL LAWRENCE RIEGER

It is certified that error appears in the above-identified patent and that said Letters Patent are hereby corrected as shown below:

Column 1, line 14, change "e.g., $ix_o$" to --e.g., $x_o$--

Column 2, equation 3, change "$(VV_{sx}$" to --$(V_{sx}$--

Column 2, line 19, change "such" (1st occurrence) to --each--

Column 3, line 33, change "(T)" to --(t)--.

Column 6, line 52, change "applid" to --applied--

Column 7, line 3, change "availabe" to --available--

Column 7, line 7, change "of" to --off--.

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*